US005852981A

United States Patent [19]

Henderson

[11] Patent Number: 5,852,981

[45] Date of Patent: Dec. 29, 1998

[54] COMPOSITE LEG ASSEMBLY FOR AN ARTICLE OF FURNITURE IN PARTICULAR A DESK OR OTHER WORK TABLE

[76] Inventor: Pieter M. Henderson, 10 Beech Road, Bedfordview, Gauteng Providence, South Africa

[21] Appl. No.: 882,614

[22] Filed: Jun. 25, 1997

[30] Foreign Application Priority Data

Jun. 25, 1996 [ZA] South Africa ..... 95/5366

[51] Int. Cl.[6] ..... A47B 3/06

[52] U.S. Cl. ..... 108/158; 108/150; 108/50.02; 248/188.1

[58] Field of Search ..... 108/156, 158, 108/158.11, 50.01, 50.02, 150; 248/188.1, 188.8, 158

[56] References Cited

U.S. PATENT DOCUMENTS

| | | | |
|---|---|---|---|
| 1,204,736 | 11/1916 | Bolens | 248/188.1 |
| 2,572,437 | 10/1951 | Bozarth | 248/158 |
| 3,267,888 | 8/1966 | Carlson | 108/158 |
| 3,968,755 | 7/1976 | Lester . | |
| 4,562,986 | 1/1986 | Frascaroli et al. | 248/188.1 |
| 5,174,532 | 12/1992 | Huang | 248/188.1 |
| 5,237,935 | 8/1993 | Newhouse et al. | 108/50.02 |
| 5,606,920 | 3/1997 | Meyer et al. | 108/50.02 |
| 5,623,881 | 4/1997 | Huang | 108/50.01 |

FOREIGN PATENT DOCUMENTS

| | | | |
|---|---|---|---|
| 0123972 | 11/1984 | European Pat. Off. . | |
| 2436439 | 2/1976 | Germany . | |
| 3814602 | 11/1989 | Germany | 108/156 |
| 1494407 | 12/1977 | United Kingdom . | |

*Primary Examiner*—Jose V. Chen
*Attorney, Agent, or Firm*—Fish & Richardson P.C

[57] ABSTRACT

A composite leg assembly for an article of furniture, in particular a desk or other work table, consists of a plurality, typically three, elongate, laterally spaced, structural members, conveniently of run-of-the-mill metal tubing, interconnected at each of the upper and lower ends by a terminal member. At least one, and usually a plurality of non-structural extrusions are supported by the structural members to define a facade which substantially envelopes and obscures the structural members to form an apparently robust and substantial leg assembly. Various additional features and furniture applications are also described.

16 Claims, 5 Drawing Sheets

COMPOSITE LEG ASSEMBLY FOR AN ARTICLE OF FURNITURE IN PARTICULAR A DESK OR OTHER WORK TABLE

FIELD OF THE INVENTION

This invention relates to a composite leg assembly for an article of furniture and more particularly, but not exclusively, for a desk or other work table. The leg may be used in a straight forward form in which it accepts vertical loading only and may also be employed in a form in which it accepts a desk or work top in cantilever fashion. The invention also relates to desks and desk assemblies employing such legs and which may optionally be provided with modesty panels, in some cases of a novel nature.

BACKGROUND TO THE INVENTION

In the field of furniture, and in particular, but not exclusively, office desks and other work tables, there is a continuous striving to produce new and aesthetically pleasing articles which preferably exhibit modern trends in design and compatibility with modern interior decorating. At the same time, it is important to control costs in order that such articles of furniture are affordable to a large sector of at least the business population.

One form of leg which has recently proved to be extremely popular is a fairly large diameter furniture leg, particularly, but not exclusively, of circular shape in cross-section, and which is usually tubular in construction. A large diameter tubular, or even for that matter solid, leg is not only costly but often heavy in weight. Thus, for example, if a metal tube is employed, because of the fact that the tube is of a relatively large diameter and made in small production runs, the tube is costly. It also uses an appreciable amount of material so that not only are the fabrication costs relatively high, but also the material costs.

OBJECT OF THE INVENTION

It is the object of this invention to provide a composite leg which can be designed to provide the appearance of a large diameter tubular leg or the like, but which is substantially less costly than a one piece leg, and which can, in addition, be used to provide aesthetic features and a cabling facility not readily capable of provision on a one piece leg.

SUMMARY OF THE INVENTION

In accordance with this invention there is provided a composite leg assembly for an article of furniture, the leg assembly comprising at least two spaced operatively upwardly extending elongate structural members interconnected at their operatively upper ends by means of an upper terminal member and at their lower ends by means of a lower terminal member and wherein the structural members have attached thereto a non-structural tubular facade made up of one or more extruded sections and wherein the facade substantially envelopes and obscures the structural members.

Further features of the invention provide for the structural members to be parallel and to be metal tubes of circular shape in cross-section and of a standard run-of-the-mill configuration; for the upper terminal member to be a plate which is operatively substantially horizontal and adapted for securing to the under surface of a desk or other work top; for the lower terminal member to likewise be a plate interconnecting the operatively lower ends of the elongate structural members; for the latter plate to be cut out of the central region of the plate defining the upper terminal member; for the lower terminal member to have associated therewith a screw threaded socket or nut formation receiving a screw threaded shank having at its operatively lower end an adjustable foot for the leg; and for there to be three symmetrically arranged parallel structural members with three extruded sections, usually plastics sections, supported between each of the three adjacent pairs of structural members to define the facade.

Still further features of the invention provide for the non-structural tubular facade to be defined by a plurality of extrusions of part-circular or part-tubular shape in cross-section and having formations along their edges co-operating with two adjacent structural members; for such co-operation with adjacent structural members to be by way of a clipping action achieved between recessed formations extending along the edges of the extrusions and the outer surfaces of the structural members; for a gap to be provided between adjacent edges of such extrusions and through which part of the outer surface of the structural members is visible and accessible; and for lateral supports for auxiliary articles such as a modesty panel, cable tray, brace or the like to extend radially out of a support member and between two adjacent extrusions defining the facade and also optionally through the upper terminal member.

The invention also provides a leg assembly as defined above and which is adapted for use in supporting a desk or other work top in cantilever fashion and wherein an elongate foot member is secured to the, or at least one, lower end of a structural member and/or the lower terminal member to extend operatively horizontally outwardly therefrom with a support foot, preferably an adjustable foot, being provided at the end of the foot member remote from the leg.

The invention also provides articles of furniture, in particular desks and associated components, having one or more legs as defined above for the support thereof.

The invention still further provides a modesty panel or cable tray assembly for use in desk assemblies and wherein the modesty panel or cable tray assembly is composed of a plurality collinear parts hingedly interconnected to allow for limited angular movement of each part relative to the other parts connected thereto. In the case of a modesty panel assembly individual panels are interconnected at operatively vertical edges thereof to provide a limited degree of relative rotation of the panels about an operatively vertical axis in order for the modesty panel to negotiate corners developed in desk assemblies. An analogous construction applies to a cable tray assembly.

In order that the above and other features of the invention may be more fully understood, one embodiment, as well as variations, will now be described with reference to the accompanying drawings.

DETAILED DESCRIPTION OF THE INVENTION WITH REFERENCE TO THE DRAWINGS

Figure 1:
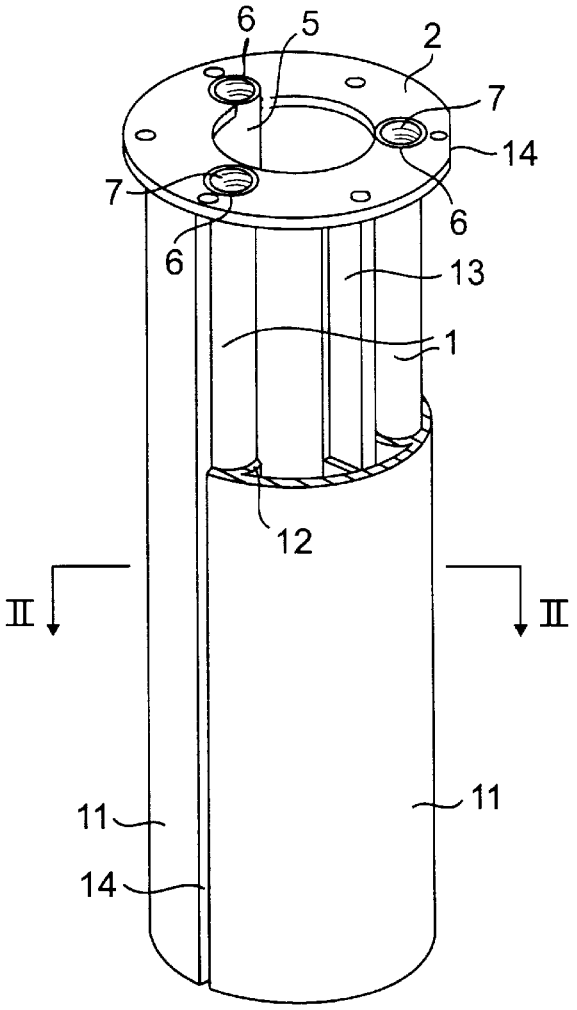
FIG. 1 is a partly broken away isometric view of a composite leg assembly according to the invention.
Figure 2:
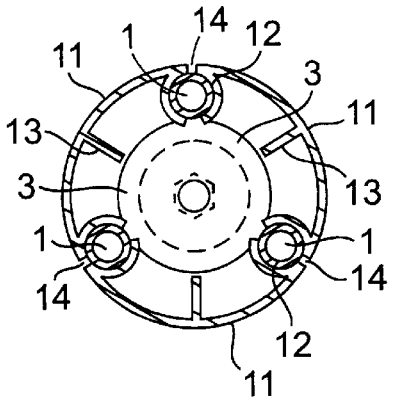
FIG. 2 is a cross-sectional plan view thereof taken along line 11 to 11 in FIG. 1.
Figure 3:
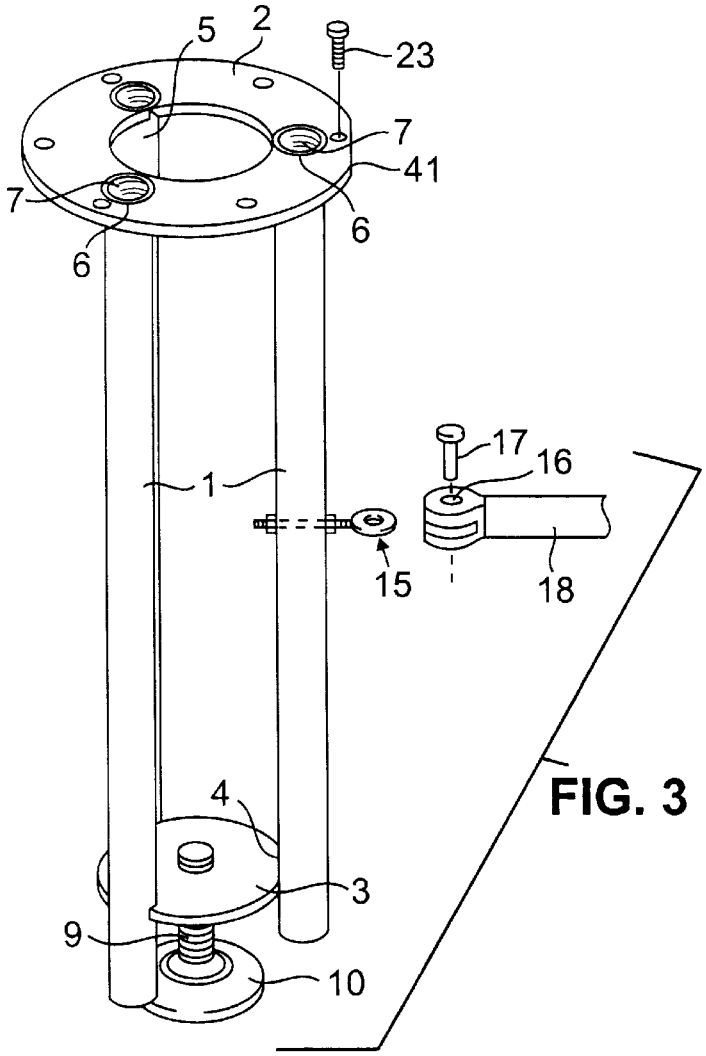
FIG. 3 illustrates in view similar to FIG. 1, the structural part of the leg assembly.

In the embodiment of the invention illustrated in FIGS. 1 to 3 a composite desk leg assembly is composed of three symmetrically spaced, parallel, operatively vertical structural members in the form of standard, run-of-the-mill metal tubes herein referred to as tubular supports (1). The three tubular supports (1) are arranged, in plan view, and as shown clearly in FIG. 2, at the apexes of an equilateral triangle.

The tubes are interconnected by a circular plate or flange (2) forming an upper terminal member at their upper ends and the diameter of which is appreciably larger than the overall diameter of the composite leg itself.

The lower end regions of the tubular supports (1) are interconnected by a lower plate (3) forming the lower terminal member and which is shaped, at the positions (4) where it contacts a tubular support, to conform to the outer surface of the tubular support adjacent the lower end thereof. For reasons both of economy and convenience, the lower plate (3) is cut out of the central region of the upper plate (2) as shown clearly in FIG. 3. The outer diameter of the lower plate is somewhat greater than that of a circle touching the inner extremities of the three tubular supports, but is less than the diameter of a circle passing through the axes of the three tubular supports The upper ends (5) of the tubular supports are preferably received in apertures (6) punched in the plate (2) to expose the upper ends of the tubular supports which are internally screw threaded as indicated by numeral (7).

The lower plate has a central nut (8) secured to its underside (see FIG. 5) which receives an operatively vertical screw threaded shank (9) carrying a foot (10) at its lower end. The foot is therefore vertically adjustable by rotating it and the shank relative to the nut and lower plate.

A large diameter non-structural facade is, in this case, formed by three lengths of plastic extrusion each defining a facade sector (11) conforming, in this case, to slightly less than one third of a circle in cross-section. The operatively vertical edges (12) of the facade sectors are shaped to conform to a part of the outer surface of each of the two adjacent tubular supports (1) so that each facade sector clips into position between two adjacent tubular supports and is maintained there by frictional forces and the resiliency of the plastics material from which the facade sectors are extruded. Each facade sector also has a central inwardly directed flange (13) which, to some extent, divides the interior of the composite leg into sectors for the purpose of guiding and maintaining electrical wires and cables which pass up the composite leg in a neat order. The facade thus substantially envelopes and obscures the tubular supports (1) and provides the appearance of a robust and substantial leg assembly.

The facade sectors are, however, dimensioned such that a small gap (14) remains between the edges of adjacent facade sectors and through which the outer surface of the tubular support is visible. This feature is used for two purposes, the first of which is to enable laterally extending fittings (15) (see FIG. 3) for example for supporting modesty panels, braces or other items to pass outwardly from the tubular supports between the edges of the adjacent facade sectors. It also has the secondary function that the tubular supports can be coated in a different colour from the material of the facade to provide a more aesthetically attractive or varied appearance than would otherwise be possible.

Figure 4A:
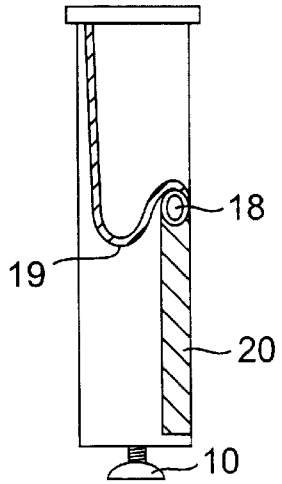
FIGS. 4*a* and 4*b* illustrate schematically, two additional functions the leg assembly may be employed to perform.
Figure 4B:
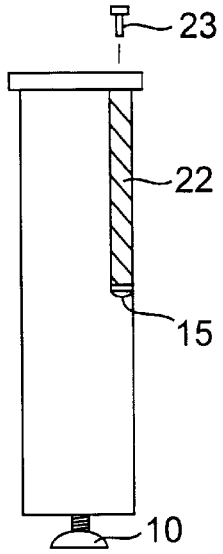

The fittings (15) preferably have an eye (16) carried at the end of a shank passing through the relevant tubular support so that a pin (17) passing through the eye can be used to attach an item to it. Such an item could be a brace (18) which, in turn, could support a cable tray (19) as shown in FIG. 4*a* or even the upper edge of a lower section (20) of a modesty panel (21). The fittings (15) could also support the lower end of a modesty panel (22) attached at its upper end to the upper plate (2) by a vertical pin (23) as shown in FIGS. 3 and 4*b*.

Figure 5:
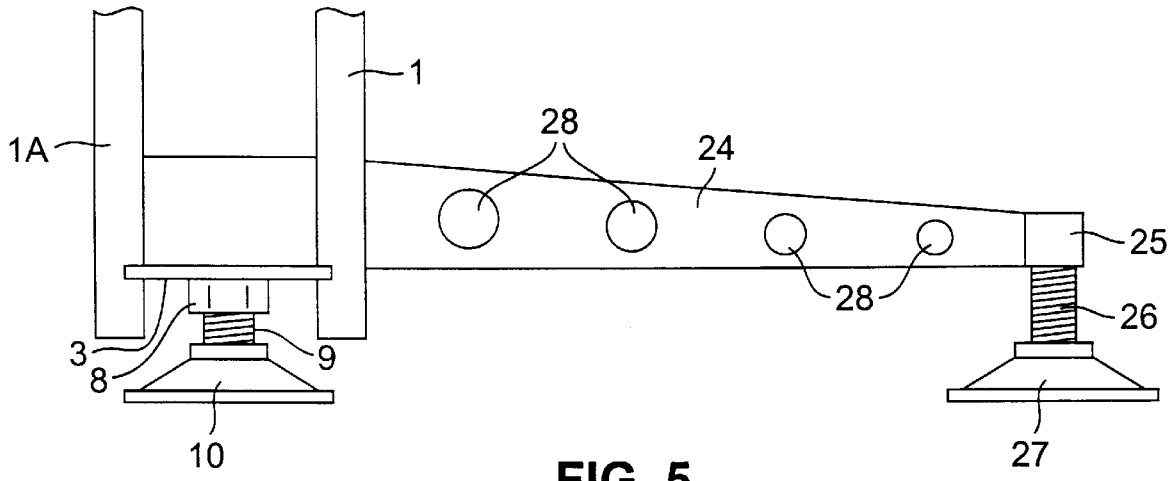
FIG. 5 illustrates the lower end of the structural part of the leg assembly in an application having an elongate foot member attached thereto for use in cantilever-type constructions.
Figure 6:
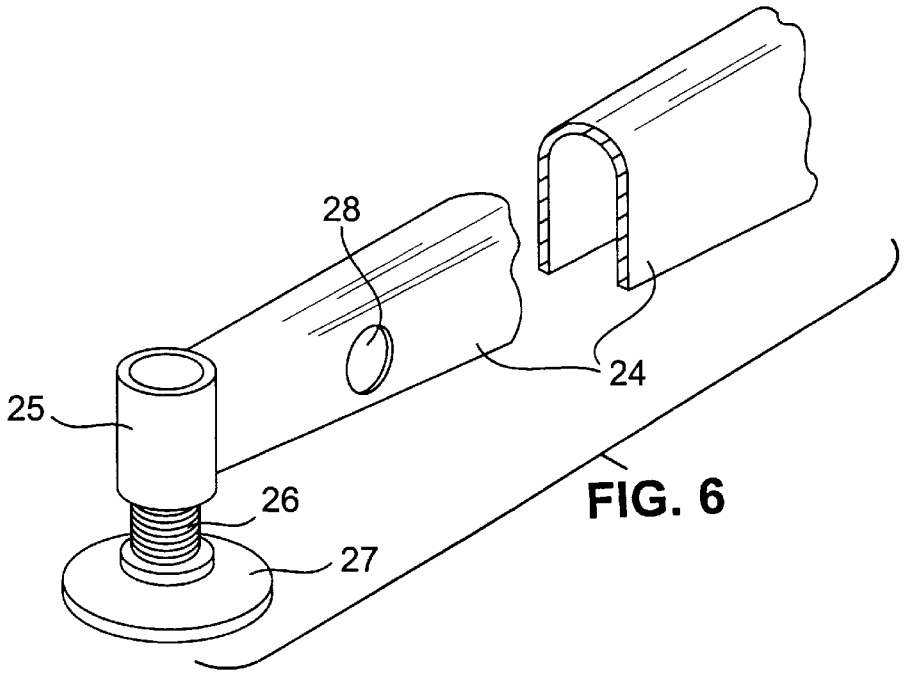
FIG. 6 is a detail, partly in section, showing the construction of the elongate foot member.

Referring now more particularly to FIGS. 5 and 6, in the event that the leg is required to be used for supporting a desk or other work top in cantilever fashion, an elongate foot member (24) can be welded to the lower end of one support member (1*a*) and to the lower plate (3) to project outwardly in one direction. The foot member is conveniently a vertically orientated inverted channel shaped plate and has attached to its free end a short length of tube (25) having a screw threaded nut (not shown) receiving a threaded shank (26) of an adjustable foot (27) similar to that described above. The aesthetic appearance of the foot is enhanced by pressing out of it holes (28).

Figure 7:
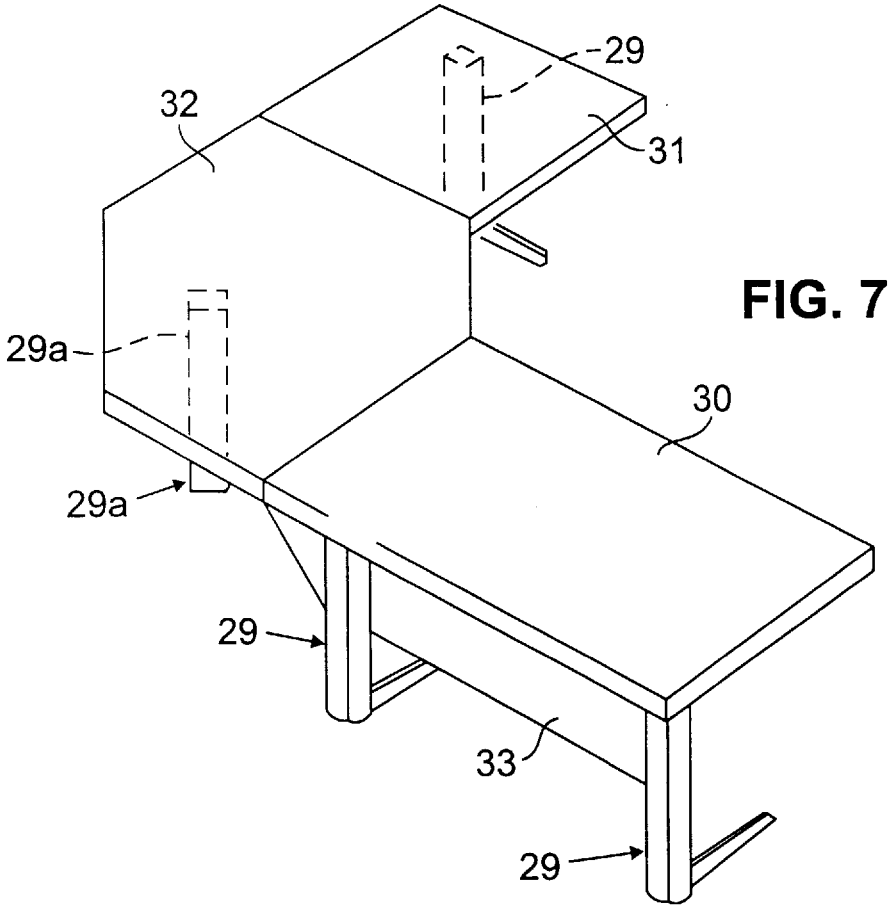
FIG. 7 illustrates in isometric view a desk assembly embodying the legs of the invention.
Figure 8:
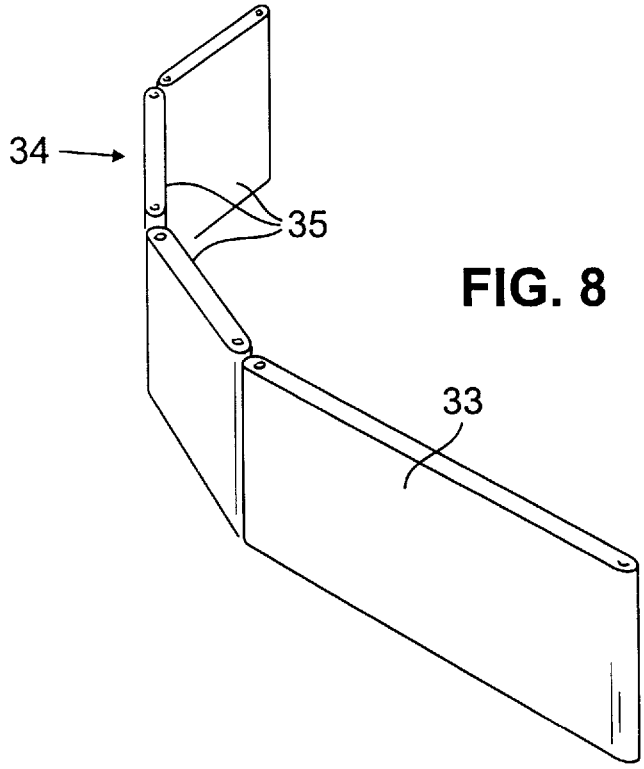
FIG. 8 illustrates in isometric view the modesty panel arrangement for the desk assembly.

As shown in FIG. 7 cantilever-style leg assemblies (29) can, for example, be used to support a desk top (30) and a side table (31) can likewise be supported in this way. An interconnecting top panel or link top (32) supported on a single leg (29*a*) of the type illustrated in FIG. 1 can be used to support this link top which in effect forms an L configuration with the side top (31) and main top (30).

A modesty panel (33) can be supported between fittings such as that indicated by numeral (15) in FIG. 3, and the upper edge of the modesty panel can be secured to the fitting by a pin (17) fixed to the lower edge of the modesty panel and passing through the fitting.

Figure 9:
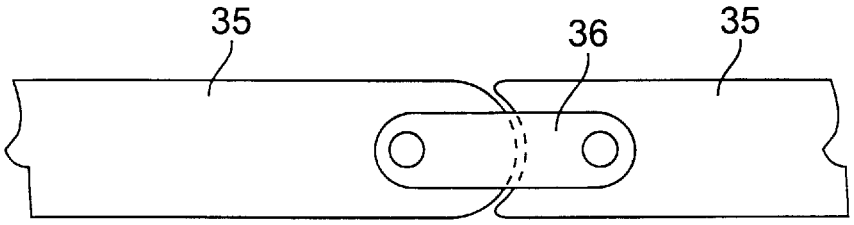
FIG. 9 is a plan view of one joint between two individual panels of the modesty panel assembly.

For the purpose of passing around the right angled corner beneath the link top (32), an articulated modesty panel assembly (34) consisting of three individual modesty panels (35) is provided. The individual panels (35) may be interconnected top and bottom by means of pivoted link connectors (36) (see FIG. 9). The individual panels can therefore rotate relative to each other to pass around the corner in an aesthetically pleasing and effective manner particularly if the edge of one panel fits neatly into a groove in the edge of the co-operant panel as illustrated in FIG. 9.

Figure 10:
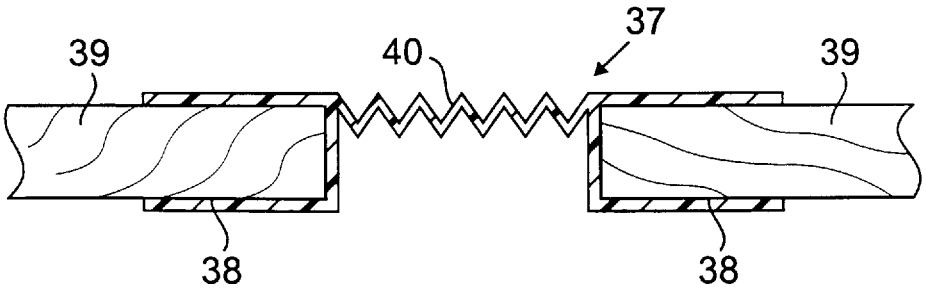
FIG. 10 is a sectional plan view of an alternative joint between two individual panels.

Alternatively, as shown in FIG. 10, an extruded plastics section (37) may have a pair of oppositely directed channel formations (38) for receiving the edges of the individual panels (39). The two channels are interconnected by a flexible web (40) conveniently of concertina configuration as shown.

In order to enable a composite leg assembly to be positioned more closely to an edge of a desk top, the upper plate may be provided with a flat (41) as shown in FIGS. 1 and 3. It should also be noted that where required holes can be provided through a desk top to provide access to the screw threaded upper ends of the support members. Extension supports can be screwed into these for supporting screens or other elevated items such as shelves.

It will be understood that numerous variations may be made to the embodiments of the invention described above without departing from the scope hereof which is limited only to the provision of a plurality of structural elongate support members carrying a non-structural facade which can assume any appearance such as that of a large diameter tubular leg, for example.

What I claim as new and desire to secure by Letters Patent is:

1. A composite leg assembly for an article of furniture, the leg assembly comprising at least two, spaced, operatively upwardly extending, elongate, compressive load-bearing structural members interconnected at their operatively upper ends by means of an upper terminal member and at their lower ends by means of a lower terminal member and wherein the structural members have attached thereto a non-structural tubular facade made up of one or more extruded sections and wherein the facade substantially envelopes and obscures the structural members.

2. A composite leg assembly as claimed in claim 1 in which the structural members are circular cross-sectioned metal tubes.

3. A composite leg assembly as claimed in claim 1 in which the upper terminal member comprises a first plate arranged to be operatively substantially horizontal and adapted for securing to the undersurface of a desk or other work top.

4. A composite leg assembly as claimed in claim 3 in which the lower terminal member comprises a second plate interconnecting the operatively lower ends of the structural members.

5. A composite leg structure as claimed in claim 4 in which the first plate defines a central region from which a cutout portion has been taken and the second plate comprises the cut out portion taken from the central region of the first plate.

6. A composite leg assembly as claimed in claim 1 in which the lower terminal member has associated therewith a screw threaded socket or nut formation receiving a screw threaded shank having at its lower end a foot.

7. A composite leg assembly as claimed in claim 1 in which there are three symmetrically arranged structural members.

8. A composite leg assembly as claimed in claim 1 in which the non-structural facade is defined by a plurality of extrusions of part-circular or part-tubular shape in cross-section with formations along their edges co-operating with, in each case, two adjacent structural members.

9. A composite leg assembly as claimed in claim 8 in which the co-operation with adjacent structural members is by way of a clipping action achieved between recessed formations extending along the edges of the extrusions.

10. A composite leg assembly as claimed in claim 8 in which a gap is provided between adjacent edges of extrusions defining the facade to expose and provide access to the structural members.

11. A composite leg assembly as claimed in claim 10 in which lateral supports for ancillary articles extend radially out of a support member between the adjacent edges of two adjacent extrusions defining the facade.

12. A composite leg assembly as claimed in claim 1 in which a laterally extending elongate foot member is provided at the lower end of the leg assembly.

13. An article of furniture comprising a composite leg assembly as defined in claim 1.

14. An article of furniture as claimed in claim 13 and wherein the article of furniture is a desk assembly.

15. An article of furniture as claimed in claim 14 in which the desk assembly includes a plurality of composite leg assemblies and one or more braces and/or modesty panels interconnected with the leg assemblies.

16. An article of furniture as claimed in claim 15 and which includes at least one brace, and wherein the brace at least partially supports either or both of a cable tray and modesty panel.

* * * * *